US009328938B2

(12) United States Patent
Michitsuji et al.

(10) Patent No.: US 9,328,938 B2
(45) Date of Patent: May 3, 2016

(54) INDOOR UNIT

(71) Applicant: DAIKIN INDUSTRIES, LTD., Osaka-shi, Osaka (JP)

(72) Inventors: Yoshiharu Michitsuji, Sakai (JP); Yoshiteru Nouchi, Sakai (JP); Tsuyoshi Yokomizo, Sakai (JP); Takashi Gotou, Sakai (JP); Yuuki Obata, Sakai (JP)

(73) Assignee: DAIKIN INDUSTRIES, LTD., Osaka-Shi (JP)

( * ) Notice: Subject to any disclaimer, the term of this patent is extended or adjusted under 35 U.S.C. 154(b) by 0 days.

(21) Appl. No.: 14/376,289

(22) PCT Filed: Feb. 1, 2013

(86) PCT No.: PCT/JP2013/000555
§ 371 (c)(1),
(2) Date: Aug. 1, 2014

(87) PCT Pub. No.: WO2013/114886
PCT Pub. Date: Aug. 8, 2013

(65) Prior Publication Data

US 2014/0374075 A1 Dec. 25, 2014

(30) Foreign Application Priority Data

Feb. 3, 2012 (JP) ..... 2012-022449

(51) Int. Cl.
*F24F 13/00* (2006.01)
*F24F 1/00* (2011.01)
*F28D 1/02* (2006.01)

(52) U.S. Cl.
CPC ..... *F24F 13/00* (2013.01); *F24F 1/0014* (2013.01); *F28D 1/02* (2013.01); *F24F 2001/0037* (2013.01)

(58) Field of Classification Search
CPC . F24F 2001/0037; F24F 1/0014; F24F 13/00; F24D 19/04; B60H 1/00464; F28D 1/024; F28D 1/02; F01P 7/10; G06F 1/20
USPC ..... 165/53, 55, 98, 99, 125, 126, 157, 159, 165/168, 170; 62/DIG. 16, 259.1; 454/292
See application file for complete search history.

(56) References Cited

U.S. PATENT DOCUMENTS 2,252,064 A * 8/1941 Cornell, Jr. ..... F24F 1/0007 165/125
2,346,410 A * 4/1944 Ashley et al. ..... 165/99

(Continued)

FOREIGN PATENT DOCUMENTS

EP 1 008 814 A1 6/2000
JP SHO 57-193111 12/1982

(Continued)

OTHER PUBLICATIONS

International Search Report, issued in PCT/JP2013/000555, dated Apr. 16, 2013.

*Primary Examiner* — Tho V Duong
*Assistant Examiner* — Raheena Rehman
(74) *Attorney, Agent, or Firm* — Birch, Stewart, Kolasch & Birch, LLP

(57) ABSTRACT

Of four corner covers (40) in an indoor unit(10), a horizontal length of an outer surface in a second corner cover (41) is the same as a horizontal length of an outer surface in a first corner cover(41), a horizontal length of an outer surface in a third corner cover (43) and a horizontal length of an outer surface in a fourth corner cover (44) are the same and are smaller than the horizontal length of the outer surface of the first corner cover(41). Opening dimensions (LA, LB, LC, LD) of four air outlet ports (14) in a horizontal direction are the same.

3 Claims, 4 Drawing Sheets

(56) References Cited

U.S. PATENT DOCUMENTS

| | | | | | |
|---|---|---|---|---|---|
| 2,662,748 | A * | 12/1953 | Huber | 165/99 | |
| 6,089,972 | A * | 7/2000 | Gunji | F24F 1/0011 | 454/233 |
| 6,450,880 | B1 * | 9/2002 | Asahina | F24F 1/0011 | 454/233 |
| 7,204,096 | B2 * | 4/2007 | Iwata | F24F 1/0007 | 454/292 |
| 7,651,390 | B1 * | 1/2010 | Profeta | F24F 13/06 | 454/284 |
| 7,908,879 | B1 * | 3/2011 | Chen | 62/259.1 | |
| 2001/0023173 | A1 * | 9/2001 | Schiedegger | F24F 7/02 | 454/367 |
| 2006/0213216 | A1 * | 9/2006 | Sakashita et al. | 62/419 | |
| 2006/0276123 | A1 * | 12/2006 | Sanagi | F24F 1/0011 | 454/292 |
| 2009/0025414 | A1 * | 1/2009 | Koga | F24F 1/0007 | 62/263 |
| 2009/0098820 | A1 * | 4/2009 | Yabu | 454/333 | |
| 2010/0192611 | A1 * | 8/2010 | Yamaguchi | F24F 1/0014 | 62/291 |
| 2010/0199697 | A1 * | 8/2010 | Sakashita | B01D 46/0065 | 62/259.1 |
| 2012/0073786 | A1 | 3/2012 | Sakashita et al. | | |

FOREIGN PATENT DOCUMENTS

| | | | | |
|---|---|---|---|---|
| JP | 10-103702 | A | | 4/1998 |
| JP | 10-111008 | A | | 4/1998 |
| JP | 10111008 | A | * | 4/1998 |
| JP | 10-213329 | A | | 8/1998 |
| WO | WO 2010/146852 | A1 | | 12/2010 |

* cited by examiner

INDOOR UNIT

TECHNICAL FIELD

The present invention relates to a ceiling-suspended indoor unit capable of blowing air in four directions.

BACKGROUND ART

An indoor unit which is disposed by being suspended from the ceiling and which is capable of blowing out air in four directions is known in the prior art (for example, Patent Document 1). The indoor unit disclosed in Patent Document 1 comprises a casing, a heat exchanger and a fan disposed inside the casing. The casing has a rectangular parallelepiped shape (a rectangular shape in bottom plan view). An air outlet port for blowing out air laterally is provided in each side (each side wall) of the casing.

In the indoor unit of Patent Document 1, one of four corner portions of the rectangular-shaped casing is provided with a piping space in which a refrigerant pipe connected to the heat exchanger, a drain pump, a drain pipe, and the like, are arranged. In contrast to a ceiling-embedded unit, virtually the whole of a ceiling-suspended indoor unit is exposed inside the room, and therefore, it is necessary to accommodate refrigerant pipes, drain pipes, and the like, inside the casing, from a design perspective. Therefore, the corner cover which covers the piping space is inevitably large, compared to the other three corner covers.

In an indoor unit of this kind, the two air outlet ports situated on both sides of the corner cover covering the piping space are smaller than the other air outlet ports, due to the restrictions imposed by the corner cover. Therefore, a problem arises in that the air flow volume blowing out from the four air outlet ports varies. Therefore, the blow distance of the air flow blown out from the air outlet ports having low air flow volume is reduced. In an indoor unit of this kind, in order to improve the balance of air flow volumes, for example, countermeasures are envisaged in which members (shutters) for closing off one portion of the air outlet ports having a large opening dimension, are disposed separately in those air outlet ports.

Furthermore, another possible countermeasure is to provide a dividing plate at a prescribed position as described in Patent Document 1. In Patent Document 1, by disposing a dividing plate and providing an air guiding path for guiding the air, variations in the air flow volume from the four air outlet ports is suppressed.

However, with each of the countermeasures described above, there is an increase in the number of components, because members such as a shutter and dividing plate, and the like, need to be provided separately. On the other hand, in place of adopting countermeasures such as adding separate members, if the sizes of the four air outlet ports are made the same, due to the size of the corner cover which covers the piping space and the size of the other three corner covers being made the same, then the opening dimensions of the respective air outlet ports become excessively small.

Patent Document 1: Japanese Patent Application Publication No. H10-103702

SUMMARY OF INVENTION

The object of the present invention is to suppress increase in the number of components, to prevent the opening dimensions of the air outlet ports from becoming too small, and to suppress variation in the air flow volume blown out from the four air outlet ports, in a ceiling-suspended indoor unit capable of blowing out air in four directions.

The indoor unit according to the present invention comprises a casing and a heat exchanger. The casing has a rectangular shape in bottom plan view. Air outlet ports for blowing out air laterally are provided respectively on four side walls along the four sides of the casing. The casing includes four corner covers. The heat exchanger is disposed inside the casing. The four corner covers include: a first corner cover disposed in a corner section where a piping space for refrigerant piping connected to the heat exchanger is provided; a second corner cover positioned diagonally opposite the first corner cover; a third corner cover positioned adjacently to the first corner cover; and a fourth corner cover positioned diagonally opposite the third corner cover. A horizontal length of an outer surface in the second corner cover is the same as a horizontal length of an outer surface in the first corner cover. A horizontal length of an outer surface in the third corner cover and a horizontal length of an outer surface in the fourth corner cover are the same, and are smaller than the horizontal length of the outer surface in the first corner cover. Opening dimensions of the four air outlet ports in a horizontal direction are the same.

DESCRIPTION OF EMBODIMENTS

Figure 1:
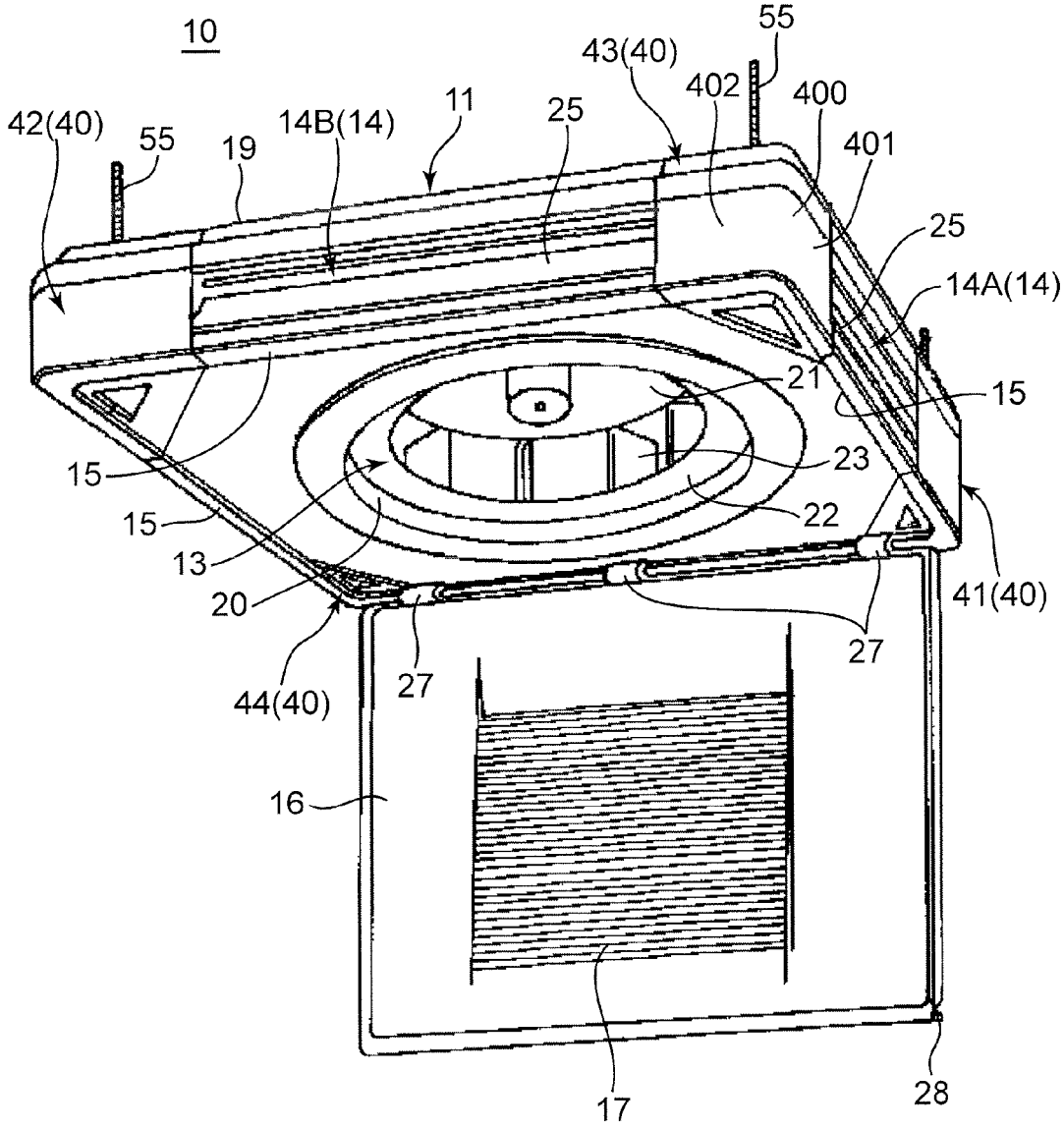
FIG. 1 is a perspective diagram showing an indoor unit relating to one embodiment of the present invention.
Figure 2:
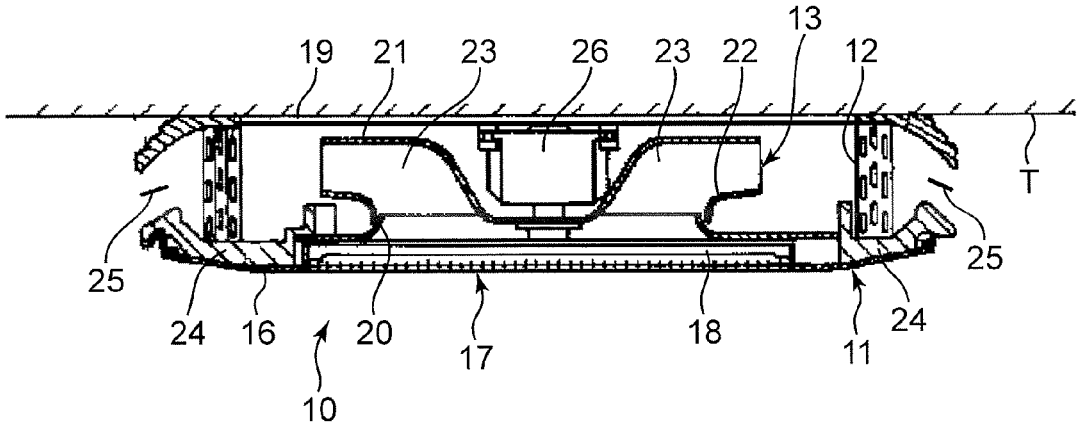
FIG. 2 is a cross-sectional diagram showing the indoor unit shown in FIG. 1.

Below, the indoor unit 10 relating to one embodiment of the present invention is described in detail with reference to the drawings. As shown in FIG. 1 and FIG. 2, the indoor unit 10 relating to the present embodiment is an indoor unit which is disposed by being suspended from a ceiling surface T (see FIG. 2). The indoor unit 10 is provided with a rectangular parallelepiped-shaped casing 11. Four air outlet ports 14 (14A to 14D) are provided in the four side walls along the four sides of the casing 11. A heat exchanger 12 disposed in a ring-like shape along the four air outlet ports 14 and a fan 13 disposed in the inner side of the heat exchanger 12 are accommodated inside the casing 11.

Figure 3:
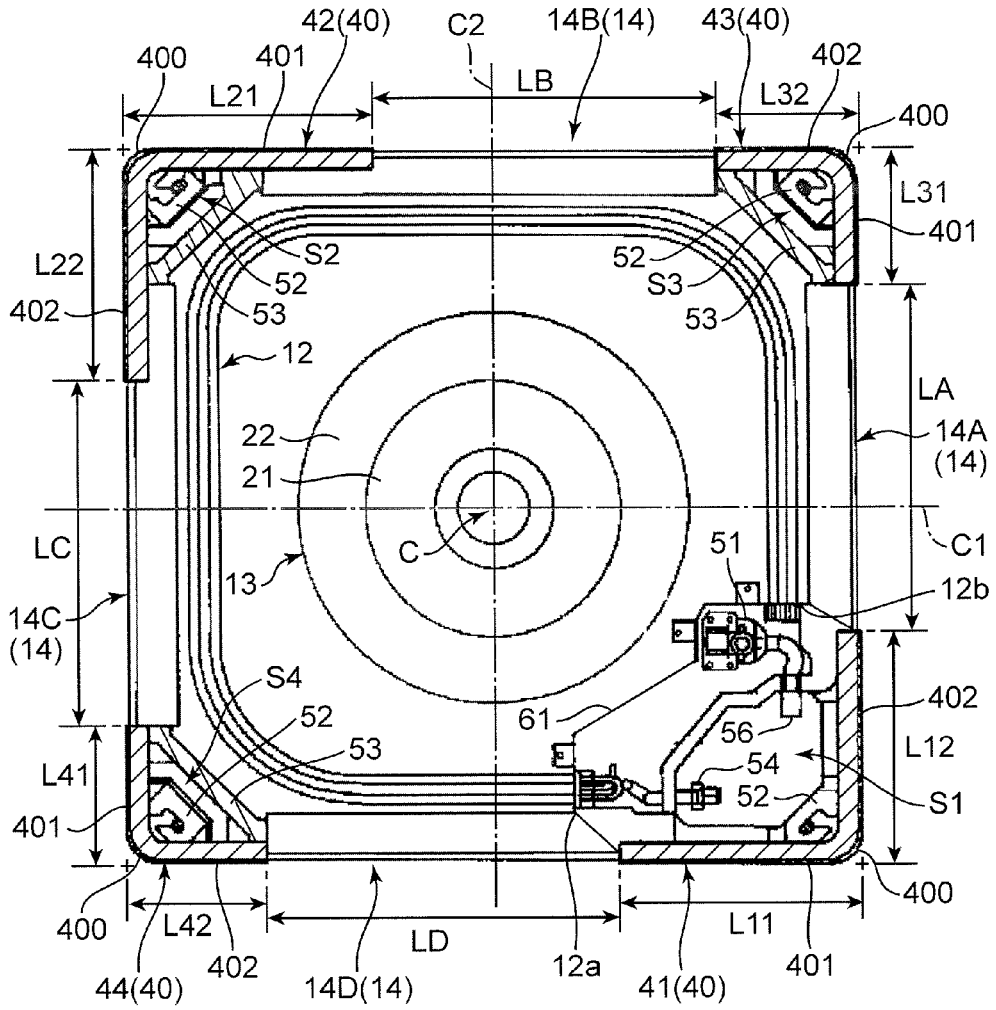
FIG. 3 is a cross-sectional diagram showing the indoor unit shown in FIG. 1.

As shown in FIG. 3, the casing 11 has a rectangular shape in bottom plan view. In particular, in the present embodiment, the casing 11 has a square shape in bottom plan view, with the lengths of the four sides being the same. The casing 11 includes a decorative plate 16 having an inflow grille 17, a top plate 19, four corner covers 40, and a decorative frame 15 extending in a horizontal direction between the adjacent corner covers 40. A filter 18 is arranged between the inflow grille 17 and the fan 13. The respective side walls of the casing 11 are composed by two adjacent corner covers 40, and the decorative frame 15 and the top plate 19 which are positioned between these.

The air outlet ports 14 are opening sections of which the shape and size are demarcated by the members which constitute the casing 11. More specifically, in the present embodiment, the opening dimension in a horizontal direction in each air outlet port 14 is defined by the corner covers 40 which are positioned on both sides thereof. Furthermore, the opening dimension in the vertical direction in each air outlet port 14 is defined by the decorative frame 15 and the top plate 19. Each of the air outlet ports 14 is substantially rectangular-shaped opening section which is demarcated by the corner covers 40 positioned on both sides thereof, the decorative frame 15 and the top plate 19. Air flow directing plates (horizontal vanes) 25 for adjusting the air blowing direction are provided in each of the air outlet ports 14.

The decorative plate 16 can be set to an open state as shown in FIG. 1, due to being attached rotatably with respect to the decorative frame 15 by hinge sections 27 provided along one edge thereof. Furthermore, the decorative plate 16 is set to a closed state by being held on the decorative frame 15 by a locking mechanism 28 provided on the opposite edge to the one edge where the hinge sections 27 are provided.

For the heat exchanger 12, it is possible to use, for example, a cross-fin heat exchanger in which a plurality of plate-shaped fins are installed so as to intersect perpendicularly with a plurality of heat conducting pipes arranged in mutually parallel configuration, but the heat exchanger 12 is not limited to this. The heat exchanger 12 functions as an evaporator during a cooling operation, and functions as a condenser during a heating operation. A drain pan 24 which collects drain water generated in the heat exchanger 12 is provided below the heat exchanger 12 (see FIG. 2).

For the fan 13, it is possible to use, for example, a centrifugal fan (turbo fan), or a diagonal flow fan, or the like. The fan 13 has an impeller provided with a round hub 21, a round shroud 22 having an air inflow opening in a central portion thereof, and a plurality of blades 23 held between the hub 21 and the shroud 22. A rotary shaft of the fan motor 26 is connected to the hub 21 of the fan 13. A bell mouth 20 for guiding the indoor air into the fan 13 is provided on the lower side of the shroud 22. This bell mouth 20 has an opening slightly smaller than an opening in the shroud 22, in a central portion thereof. When the impeller of the fan 13 turns, the indoor air is sucked into the casing 11 via the inflow grille 17 of the decorative plate 16, is passed through the heat exchanger 12, and is then blown out laterally from the air outlet ports 14.

A piping space S1 is provided in a first corner section of the four corner sections inside the casing 11. This piping space S1 is partitioned by a dividing plate 61 from the space where the fan 13 is provided (see FIG. 3). The piping space S1 includes a connecting part for connecting a refrigerant pipe (not illustrated) from outside the indoor unit 10, to the heat exchanger 12, and a working space for carrying out the related connection work. A refrigerant pipe 54, drain pump 51, drain pipe 56, and suspension clasp 52 to which a suspension bolt 55 (see FIG. 1) for suspending the casing 11 from the ceiling are attached, are arranged in the piping space S1. The pipe plates 12*a*, 12*b* at both end portions of the heat exchanger 12 are arranged in the vicinity of the piping space S1.

In the other three corner sections of the casing 11, in other words, the second corner section, the third corner section and the fourth corner section, spaces S2, S3, S4 are formed, the spaces S2, S3, S4 being partitioned by a heat-insulating material 53 from the space where the heat exchanger 12 is provided. Suspending clasps 52 are arranged respectively in these spaces S2, S3, S4.

The members, such as the refrigerant pipe 54, the drain pipe 56, the suspension clasp 52, and the like, which are arranged in the piping space S1, are covered by a first corner cover 41 which is detachable with respect to the decorative frame 15. The members, such as the suspension clasp 52, which are arranged in the space S2 positioned diagonally opposite the piping space S1, are covered by a second corner cover 42. Similarly, the members, such as the suspension clasp 52, which are arranged in the space S3, are covered by a third corner cover 43, and the members, such as the suspension clasp 52, which are arranged in the space S4, are covered by a fourth corner cover 44.

The size of the first corner cover 41 is a size which is capable of covering, from the outside, all or a part of the members arranged in the piping space S1. In the present embodiment, the size of the second corner cover 42 which is positioned diagonally opposite the first corner cover 41 is made the same size as the first corner cover 41, and hence the conventional problems described above are resolved and the balance of the air flow volume blown out from the plurality of air outlet ports 14 is improved.

In other words, in the present embodiment, the horizontal length of the outer surface in the first corner cover 41 and the horizontal length of the outer surface in the second corner cover 42 are the same. The horizontal length of the outer surface in the third corner cover 43 and the horizontal length of the outer surface in the fourth corner cover 44 are the same, are set to the minimum size capable of covering, from the outside, the required region in the corresponding space, and are smaller than the horizontal length of the outer surface in the first corner cover 41. The both end portions of each air outlet port 14 in the horizontal direction are demarcated by two corner covers 40 positioned on both sides of the air outlet port 14. By this means, in the present embodiment, it is possible to make the opening dimensions, in the horizontal direction, of the four air outlet ports 14 (the lengths LA, LB, LC, LD in FIG. 3) the same, even if a separate member, such as a shutter, is not provided as in the prior art.

Furthermore, in the present embodiment, the outer shape of the outer surface in the first corner cover 41, and the outer shape of the outer surface in the second corner cover 42 are the same, but they do not necessarily have to be the same, and may be different to a greater or lesser extent. The outer shape of the outer surface in the third corner cover 43, and the outer shape of the outer surface in the fourth corner cover 44 are the same, but they do not necessarily have to be the same, and may be different to a greater or lesser extent.

In the present embodiment, the "same outer shape" and the "same size" do not only mean that the shape or size is precisely the same, but also include cases where there are differences due to tolerances, errors, or the like, which would be acceptable to a person skilled in the art, in the forming process.

A more concrete description of the present embodiment is given below. As shown in FIG. 1 and FIG. 3, each of the corner covers 40 constitutes the outer surface of the corresponding corner section in the casing 11. In the cross-section of the corner covers 40 along a plane parallel to the horizontal direction (the cross-section shown in FIG. 3), the outer surfaces of the corner covers 40 have an L-shape. In other words, the outer surfaces of the corner covers 40 include an edge line section 400 extending in the vertical direction in the corner section, a first side surface 401 and a second side surface 402. The first side surface 401 extends from the edge line section 400 towards one of the adjacent corner covers 40. The second side surface 402 extends from the edge line section 400 towards the other of the adjacent corner covers 40. The horizontal length of the outer surface in each of the corner covers 40 is the sum of the horizontal length of the first side surface 401 and the horizontal length of the second side surface 402. The edge line section 400 is a portion that corresponds to a corner of the rectangular shape of the rectangular-shaped casing 11. The first side surface 401 and the second side surface 402 intersect with each other perpendicularly.

As described above, the third corner cover 43 and the fourth corner cover 44 are smaller than the first corner cover 41 and the second corner cover 42. The sizes of the corner covers 40 can be compared by the sum value of the horizontal length of the first side surface 401 and the horizontal length of the second side surface 402. For example, the size of the third corner cover 43 is the sum value of the horizontal length L31 and the horizontal length L3l, the size of the first corner cover 41 is the sum value of the horizontal length L11 and the horizontal length L12. As described below, in the present embodiment, in each of the corner covers 40, the horizontal length of the first side surface 401 and the horizontal length of the second side surface 402 are the same, and therefore, in this case, the sizes of the corner covers 40 may be compared by either the horizontal lengths of the first side surfaces 401 or the horizontal lengths of the second side surfaces 402.

Furthermore, in the present embodiment, the edge line section 400 has a shape that curves smoothly (a chamfer-like surface). Therefore, for example, the horizontal length L11 of the first side surface 401 of the first corner cover 41 means the distance to the end of the first corner cover 41 on the side of the fourth corner cover 44, from the point of intersection of a straight line that is an extended line of the first side surface 401 and a straight line that is an extended line of the second side surface 402, in the cross-sectional diagram in FIG. 3. The same applies to the other lengths described above.

In the cross-sectional diagram in FIG. 3, the outer surfaces of the four corner covers 40 have a rotationally symmetric shape so as to have the same length before and after movement through 180 degrees about a straight line passing in the vertical direction through the center C. More specifically, the horizontal length L11 of the first side surface 401 in the first corner cover 41 and the horizontal length L21 of the first side surface 401 in the second corner cover 42 are the same, and the horizontal length L12 of the second side surface 402 in the first corner cover 41 and the horizontal length L22 of the second side surface 402 in the second corner cover 42 are the same. Furthermore, the horizontal length L31 of the first side surface 401 in the third corner cover 43 and the horizontal length L41 of the first side surface 401 in the fourth corner cover 44 are the same, and the horizontal length L32 of the second side surface 402 in the third corner cover 43 and the horizontal length L42 of the second side surface 402 in the fourth corner cover 44 are the same. In other words, the outer surface of the first corner cover 41 and the outer surface of the second corner cover 42 have the same horizontal lengths in portions that are mutually parallel (the mutually parallel side surfaces), and the outer surface of the third corner cover 43 and the outer surface of the fourth corner cover 43 have the same horizontal lengths in the portions that are mutually parallel (the mutually parallel side surfaces).

In each of the corner covers 40, the horizontal length of the first side surface 401 and the horizontal length of the second side surface 402 may be different, but in the present embodiment, they are the same length. By making the horizontal length of the first side surface 401 and the horizontal length of the second side surface 402 the same in each of the corner covers 40, a good arrangement balance of the four air outlet ports 14 is achieved. A specific explanation is as follows.

The two air outlet ports 14A, 14B which are on both sides of the third corner cover 43 are provided at positions displaced by the same dimension towards the side of the third corner cover 43 with respect to the centers of the sides where the air outlet ports 14A, 14B are provided (the points through which the straight lines C1, C2 pass). In other words, the center, in the horizontal direction, of the air outlet port 14A on one side of the third corner cover 43 is positioned towards the side of the third corner cover 43 from the center, in the horizontal direction, of the side corresponding to the air outlet port 14A (the point through which the straight line C1 passes). The center, in the horizontal direction, of the air outlet port 14B on the other side of the third corner cover 43 is positioned towards the side of the third corner cover 43 from the center, in the horizontal direction, of the side corresponding to the air outlet port 14B (the point through which the straight line C2 passes). The distance between the center, in the horizontal direction, of the air outlet port 14A on one side of the third corner cover 43 and the center, in the horizontal direction, of the side corresponding to the air outlet port 14A is the same length as the distance between the center, in the horizontal direction, of the air outlet port 14B on the other side of the third corner cover 43 and the center, in the horizontal direction, of the side corresponding to the air outlet port 14B.

The straight line C1 in FIG. 3 is a straight line passing through the respective centers of two opposing sides in the casing 11 which has a rectangular shape in bottom plan view, and the straight line C2 is a straight line passing through the respective centers of the remaining two sides.

Furthermore, the two air outlet ports 14C, 14D which are on both sides of the fourth corner cover 44 are provided at positions displaced by the same dimension towards the side of the fourth corner cover 44 with respect to the centers of the sides where the air outlet ports 14C, 14D are provided (the points through which the straight lines C1, C2 pass). In other words, the center, in the horizontal direction, of the air outlet port 14C on one side of the fourth corner cover 44 is positioned towards the side of the fourth corner cover 44 from the center, in the horizontal direction, of the side corresponding to the air outlet port 14C (the point through which the straight line C1 passes). The center, in the horizontal direction, of the air outlet port 14D on the other side of the fourth corner cover 44 is positioned towards the side of the fourth corner cover 44 from the center, in the horizontal direction, of the side corresponding to the air outlet port 14D (the point through which the straight line C2 passes). The distance between the center, in the horizontal direction, of the air outlet port 14C on one side of the fourth corner cover 44 and the center, in the horizontal direction, of the side corresponding to the air outlet port 14C is the same length as the distance between the center, in the horizontal direction, of the air outlet port 14D on the other side of the fourth corner cover 44 and the center, in the horizontal direction, of the side corresponding to the air outlet port 14D.

Furthermore, in the present embodiment, the position of the air outlet port 14 is as follows, when specified with reference to the corner covers 40. Specifically, in each corner cover 40, the two air outlet ports 14 situated on both sides of the each corner cover 40 are provided at positions which are the same distance from the each corner cover 40. In other words, the two air outlet ports 14 on both sides of each corner cover 40 are provided at positions that are the same distance from the each corner cover 40. Specifically, for example, the two air outlet ports 14A, 14D situated on both sides of the first corner cover 41 are provided at positions which are the same distance from the edge line section 400 of the first corner cover 41. More specifically, the air outlet ports 14A, 14D are provided at positions which are the same distance from the point of intersection of a straight line that is an extended line of the first side surface 401 of the first corner cover 41 and a straight line that is an extended line of the second side surface 402. In other words, the horizontal length L11 and the horizontal length L12 are the same, and the length LA (the opening dimension in the horizontal direction of the air outlet port 14A) and the length LD (the opening dimension in the horizontal direction of the air outlet port 14D) are the same.

Consequently, when any particular corner cover 40 and the two air outlet ports 14 situated on both sides of the corner cover 40 are viewed obliquely from below, the two air outlet ports 14 are arranged at substantially symmetrical positions with respect to the corner cover 40, and therefore an excellently balanced external appearance is achieved.

As described above, in the present embodiment, in the first corner cover 41 and the second corner cover 42 which are positioned in one pair of opposing corners, of the four corner covers 40, the horizontal lengths of the outer surfaces are the same as each other. In the third corner cover 43 and the fourth corner cover 44 which are positioned in the other pair of opposing corners, the horizontal lengths of the outer surfaces are the same as each other and are smaller than the horizontal lengths of the outer surfaces of the first corner cover. Therefore it is possible to match the horizontal-direction opening dimensions LA, LB, LC, LD of the four air outlet ports 14, to the same length, without making the opening dimensions excessively small. Consequently, increase in the number of components is suppressed, excessive reduction in the opening dimensions of the air outlet ports is restricted, and variation in the air flow volumes blowing out from the four air outlet ports can be suppressed.

The present invention is not limited to the embodiment described above and various modifications, improvements, and the like can be applied within a scope that does not depart from the essence of the invention.

In the present embodiment, an example is described in which the casing 11 is a square shape in bottom plan view, but the invention is not limited to this and the casing 11 may also have a rectangular shape in which the adjacent sides have different lengths.

Figure 4:
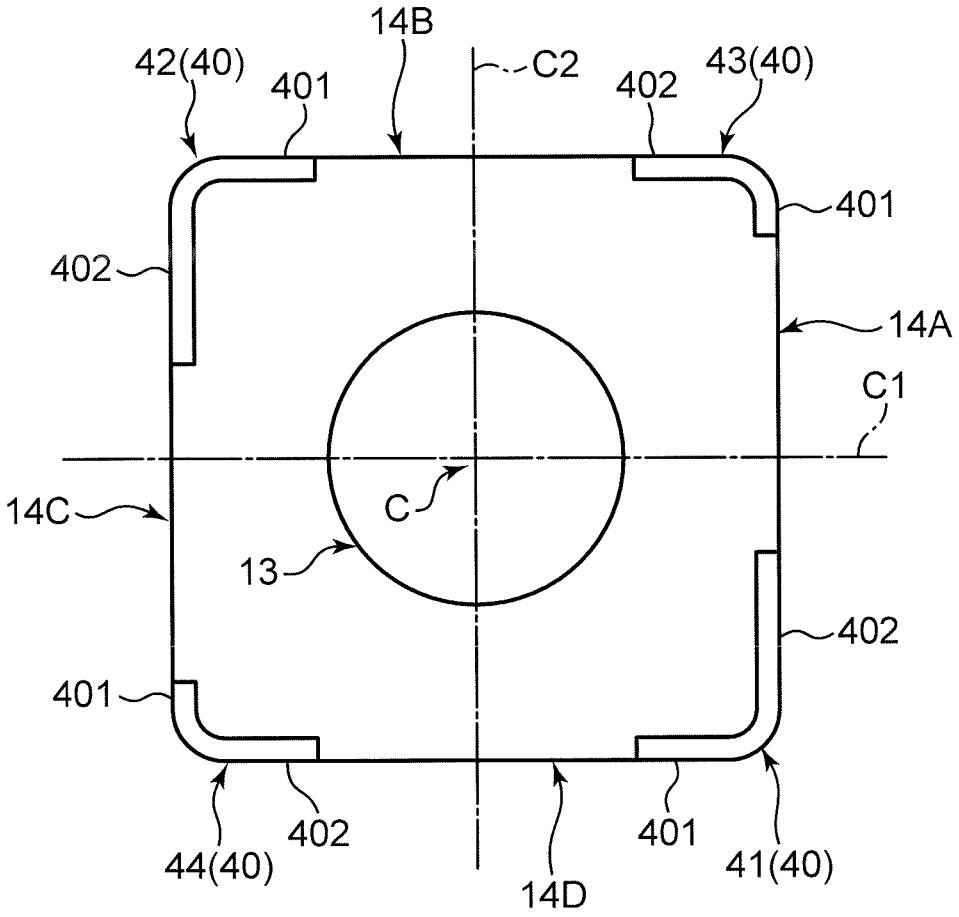
FIG. 4 is a schematic diagram showing a modification example of the indoor unit.

Furthermore, in the present embodiment, an example is shown in which, in each of the corner covers 40, the horizontal length of the first side surface 401 and the horizontal length of the second side surface 402 are the same, but the invention is not limited to this. For example, the horizontal length of the first side surface 401 and the horizontal length of the second side surface 402 may be different, as in the modification example shown in FIG. 4. In this modification example also, the third corner cover 43 and the fourth corner cover 44 are smaller than the first corner cover 41 and the second corner cover 42. Moreover, in FIG. 4, the outer surfaces of the four corner covers 40 have a rotationally symmetric shape whereby the corner covers are arranged in the same positions before and after rotation through 180 degrees about a straight line in the vertical direction passing through the center C; and the horizontal-direction opening dimensions LA, LB, LC, LD of the four air outlet ports 14A, 14B, 14C and 14D are the same. In this modification example, the air outlet port 14A is provided at a position displaced towards the side of the third corner cover 43 with respect to the center of the side corresponding to the air outlet port 14A (the point through which the straight line C1 passes), and the air outlet port 14C is provided at a position displaced by the same dimension towards the side of the fourth corner cover 44 with respect to the center of the side corresponding to the air outlet port 14C (the point through which the straight line C1 passes). On the other hand, the centers of the air outlet ports 14B, 14D in the horizontal direction coincide with the centers of the sides corresponding to those air outlet ports 14B, 14D (the points through which the straight line C2 passes). In FIG. 4, a portion of the members, such as the heat exchanger 12, are not illustrated.

An overview of the embodiment described above is as follows.

The indoor unit includes: a casing having a rectangular shape in bottom plan view, air outlet ports for blowing out air laterally being provided respectively in four side walls along four sides thereof, and the casing including four corner covers; and a heat exchanger disposed inside the casing. The four corner covers include: a first corner cover disposed in a corner section where a piping space for refrigerant piping connected to the heat exchanger is provided; a second corner cover positioned diagonally opposite the first corner cover; a third corner cover positioned adjacently to the first corner cover; and a fourth corner cover positioned diagonally opposite the third corner cover. A horizontal length of the outer surface in the second corner cover is the same as a horizontal length of the outer surface in the first corner cover. A horizontal length of the outer surface in the third corner cover and a horizontal length of the outer surface in the fourth corner cover are the same, and are smaller than the horizontal length of the outer surface in the first corner cover. The opening dimensions of the four air outlet ports in a horizontal direction are the same.

In this composition, in the first corner cover and the second corner cover which are positioned in one pair of opposing corners, of the four corner covers, the horizontal lengths of the outer surfaces are the same as each other, and in the third corner cover and the fourth corner cover, which are positioned in another pair of opposing corners, the horizontal lengths of the outer surfaces are the same as each other and are smaller than the horizontal lengths of the outer surfaces of the first corner cover. Therefore it is possible to match the horizontal-direction opening dimensions of the four air outlet ports, to the same length, without excessively reducing the opening dimensions. Consequently, increase in the number of components is suppressed, excessive reduction in the opening dimensions of the air outlet ports is restricted, and variation in the air flow volumes blowing out from the four air outlet ports can be suppressed. A specific explanation is as follows.

More specifically, in this composition, the second corner cover which is positioned diagonally opposite the first corner cover is made larger so as to be of the same length as the first corner cover, and the remaining two corner covers which have the same length as each other, namely, the third corner cover and the fourth corner cover, are not made larger as in the second corner cover, but rather are kept smaller than the first corner cover. In this way, the third corner cover and the fourth corner cover are kept smaller than the first corner cover, and therefore it is possible to stop the opening dimensions of the air outlet ports from becoming too small, and moreover, it is possible to keep the four air outlet ports to the same opening dimension, even if a separate member is not provided, as in the prior art.

In the indoor unit, preferably, lengths of the four sides of the casing are the same, the two air outlet ports situated on both sides of the third corner cover are provided at positions displaced by the same dimension towards the third corner cover side with respect to the centers of the sides corresponding those air outlet ports, and the two air outlet ports situated on both sides of the fourth corner cover are provided at positions displaced by the same dimension towards the fourth corner cover side with respect to the centers of the sides corresponding to those air outlet ports.

In this composition, when any particular corner cover and the two air outlet ports situated on either side of the corner cover are viewed obliquely from below, the two air outlet ports are arranged at substantially symmetrical positions with respect to the corner cover, and therefore an excellently balanced external appearance is achieved.

Furthermore, in the indoor unit described above, the two air outlet ports situated on both sides of each corner cover may be provided at positions that are the same distance from the each corner cover.

In this composition, when any particular corner cover and the two air outlet ports situated on either side of the corner cover are viewed obliquely from below, the two air outlet ports are arranged at substantially symmetrical positions with respect to the corner cover, and therefore an excellently balanced external appearance is achieved.

10 indoor unit
11 casing
12 heat exchanger
13 fan
14 air outlet port
15 decorative frame
16 decorative plate
17 inflow grille
19 top plate
40 corner cover
41 first corner cover
42 second corner cover
43 third corner cover
44 fourth corner cover
51 drain pump
54 refrigerant pipe
56 drain pipe
S1 piping space
LA, LB, LC, LD horizontal-direction opening dimension of air outlet port.

The invention claimed is:

1. An indoor unit, comprising:

a casing having a rectangular shape in bottom plan view, and having air outlet ports for blowing out air laterally that are provided respectively in four sides thereof, and having four corner covers demarcating the air outlet ports, wherein the lengths of the four sides of the casing are the same; and a heat exchanger disposed inside the casing, wherein the four corner covers include:

a first corner cover disposed in a corner section where a piping space for refrigerant piping connected to the heat exchanger is provided;

a second corner cover positioned diagonally opposite the first corner cover;

a third corner cover positioned adjacently to the first corner cover; and a fourth corner cover positioned diagonally opposite the third corner cover;

a total length in a horizontal plane of an outer surface of the second corner cover is the same as a total length in the horizontal plane of an outer surface of the first corner cover;

a total length in the horizontal plane of an outer surface in the third corner cover and a total length in the horizontal plane of an outer surface of the fourth corner cover are the same, and are smaller than the total length in the horizontal plane of the outer surface of the first corner cover;

opening dimensions of the four air outlet ports in a horizontal direction which are defined by the corner covers which are positioned on both sides of the air outlet port are the same; and the outer surface of each of the first, second, third and fourth corner covers includes first and second side surfaces that extend in the horizontal plane toward respective ones of the adjacent corner covers, wherein a length in the horizontal plane of each of the first and second side surfaces is half of the total length in the horizontal plane of the outer surface of the respective corner cover.

2. The indoor unit according to claim 1, wherein the two air outlet ports situated at positions sandwiching the third corner cover are provided at positions displaced by the same dimension towards the third corner cover side with respect to the centers of the sides provided with those air outlet ports; and the two air outlet ports situated at positions sandwiching the fourth corner cover are provided at positions displaced by the same dimension towards the fourth corner cover side with respect to the centers of the sides provided with those air outlet ports.

3. The indoor unit according to claim 1, wherein the two air outlet ports situated at positions sandwiching each of the four corner covers are provided at positions which are the same distance from the each corner cover.

* * * * *